United States Patent [19]

Yamada et al.

[11] Patent Number: 4,993,174

[45] Date of Patent: Feb. 19, 1991

[54] CERAMICS SPIKE PIN

[75] Inventors: Masamichi Yamada; Yoshinori Hattori; Masakatsu Hayakawa, all of Nagoya, Japan

[73] Assignee: NGK Spark Plug Company, Ltd., Aichi, Japan

[21] Appl. No.: 511,429

[22] Filed: Apr. 23, 1990

[30] Foreign Application Priority Data

May 3, 1989 [JP] Japan ..... 1-51976

[51] Int. Cl.[5] ..... A43B 5/00

[52] U.S. Cl. ..... 36/134; 36/126; 36/127; 36/67 A

[58] Field of Search ..... 36/134, 67 D, 67 R, 36/67 A, 67 B, 59 R, 126, 127, 128, 129

[56] References Cited

U.S. PATENT DOCUMENTS 2,774,151 12/1956 Dahlquist et al. ..... 36/67 D
4,667,425 5/1987 Effler et al. ..... 36/59 R

FOREIGN PATENT DOCUMENTS 56-28703 3/1981 Japan .
0015080 1/1983 Japan ..... 36/134
63-19163 4/1988 Japan .

*Primary Examiner*—Paul T. Sewell
*Assistant Examiner*—M. D. Patterson
*Attorney, Agent, or Firm*—Finnegan, Henderson, Farabow, Garrett & Dunner

[57] ABSTRACT

A ceramics spike pin is provided with a pin body having a horizontal cross section of a substantially circular shape, which pin body is provided with a rounded free end portion having a predetermined radius of curvature and a connecting base portion having a predetermined radius of curvature, and a horizontally expanded base connected to the connecting base portion, wherein a diameter (d) of the connecting base portion in horizontal cross section, the radius of curvature(r) of the connecting base portion, and a maximum diagonal length (D) of the horizontally expanded base satisfy the relationship of $0<r<d<D$ and $r^2 \times d/D \geqq 1.36$. Accordingly, the stress concentration can be greatly relieved, and the impact resistance can be improved to thereby the durability.

10 Claims, 2 Drawing Sheets

CERAMICS SPIKE PIN

BACKGROUND OF THE INVENTION

1. Field of the Invention

The present invention relates to a ceramics spike pin improved in impact resistance for use with shoes or the like for golf, baseball, soccer, etc.

2. Description of the Related Art

A known ceramics spike pin for golf shoes or the like is constructed of a pin body having a rounded outer circumference and a horizontally expanded base having a rounded outer circumference, wherein the outer circumference of the pin body is connected through a gently curved surface to the horizontally expanded base (cf. Japanese Paten Laid-open Publication No. 56-28703 and Japanese Patent Publication No. 63-35607).

However, the known spike pin has a problem in durability such that an impact strength is not sufficient for practical use.

SUMMARY OF THE INVENTION

It is an object of the present invention to provide a ceramics spike pin which greatly relieves the stress concentration and improves the impact resistance to thereby improve the durability.

According to the present invention, there is provided a ceramics spike pin comprising a pin body having a horizontal cross section of a substantially circular shape, said pin body being provided with a rounded free end portion having a predetermined radius of curvature and a connecting base portion having a predetermined radius of curvature, and a horizontally expanded base connecyed to said connecting base portion, wherein a diameter (d) of said connecting base portion in horizontal cross section, the radius of curvature (r) of said connecting base portion, and a maximum diagonal length (D) of said horizontally expanded base satisfy the relationship of $0 < r < d < D$ and $r^2 \times d/D \geqq 1.36$.

DETAILED DESCRIPTION OF THE INVENTION

In accordance with the present invention, the above-mentioned maximum diagonal length D means a maximum value of diagonal lengths of the horizontally expanded base in horizontal cross section. In the case that the horizontal cross section of the horizontally expanded base is circular, the maximum diagonal length D is a diameter. In the other casees, the maximum diagonal length D is a maximum length in various shapes as shown in FIGS. 5, 6 and 7, for example.

The ceramics forming the spike pin are selected from the group consisting of a partially stabilized zirconia sintered material and a cermet having a bending strength of 90 kg/mm$^2$ or more and a fracture toughness of 5 MN/m$^{\frac{1}{2}}$ or more.

As mentioned above, the horizontal cross section of the pin body is substantially circular, and the outer circumference thereof is rounded, so as to reduce the stress concentration. Such a substantially circular shape is preferably a really circular shape, and includes a slightly elliptical shape. The horizontal cross section of the horizontally expanded base may have various shapes such as a circular shape and a polygonal shape or the like. Examples of such a polygonal shape may include a track-shaped configuration as shown in FIG. 5, a tetragonal shape as shown in FIG. 6, and a hexagonal shape as shown in FIG. 7. Normally, each of these shapes has rounded or chamfered corners.

As the free end portion of the pin body is so rounded as to have a predetermined radius of curvature, the stress concentration can be reduced. In this respect, the radius of curvature of the free end portion is preferably as large as possible. Further, the radius of curvature(r) of the connecting base portion of the pin body is also preferably as large as possible for the purpose of greatly reducing the stress concentration. Although the diameter(d) of the connecting base portion is smaller than the maximum diagonal length(D) of the horizontally expanded base, a difference between the diameter (d) and the maximum diagonal length(D) is preferably as small as possible for the purpose of greatly reducing a force to be applied to the pin body by the horizontally expanded base. However, the difference is set to preferably 1 mm or more, so as to firmly unite the pin with a shoe by using a flange as a mating member. Further, as a plurality of spike pins are fixed to the shoe from a functional point of view, the maximum diagonal length(D) is set to preferably 15 mm or less.

In considering an impact to be applied to the spike pin in practiacl use, the spike pin is required to endure an impact of 0.3 kg·m or more. The inventor has conducted a drop impact test as shown in FIG. 4 to investigate the relationship among the radius of the curvature(r) of the connecting base portion, the diameter(d) of the connecting base portion and the maximum diagonal length(D) of the horizontally expanded base, As the result of investigation, it has been found that the relationship as shown in FIG. 3 is present, and that the spike pin is required to have the condition of $r^2 \times d/D \geqq 1.36$ in order to endure the impact of 0.3 kg·m or more.

Although the ceramics forming the spike pin according to the present invention is not limited to a specific material so far as the above-mentioned condition is satisfied, a partially stabilized zirconia or a cermet having a bending strength of 90 kg/mm$^2$ or more and afracture toughness of 5 MN/m$^{\frac{1}{2}}$ or more is preferably selected, so as to satisfy the above-mentioned condition easily and reliably. The partially stabilized zirconia may be selected from known zirconia materials such as zirconia stabilized by $Y_2O_3$ or CaO. Further, Silicon Nitride ($Si_3N_4$), Sialon($Si_4Al_2N_6O_2$) or the like may be used as ceramics materials. The cera-mics acording to the present invention include a cermet to be selected from various known cermet materials, for example Tungsten carbide (WC)-Cobalt (Co), Titanium carbide(TiC)-Molibdem(Mo)-Nickel(Ni) or the like.

As descrived above, in the spike pin according to the present invention, the radius of curvature(r) of the connecting base portion of the pin body, the diameter(d) of the connecting base portion and the maximum diagonal length(D) of the horizontally expanded base satisfy the relationship of $0 < r < d < D$ and $r^2 \times d/D \geqq 1.36$. Therefore, the stress concentration to be applied to the pin body is greatly relieved to thereby obtain a sufficient impact strength of 0.3 kg·m or more fittable for practiacl use.

Furthermore, as the horizontal cross section of the pin body is substantially circular, and the outer circumference thereof is rounded. In addition, the free end portion of the pin body is rounded. Therefor, chipping of the pin body is hard to occur. Moreover, as the dimentaional difference between the connecting base portion and the horizontally expanded base is provided, the spike pin can be firmly united with the shoe by using a flange.

In the case of using a partially stabilized zirconia sintered material or a cermet having the predetermined characteristics as the ceramics forming the spike pin, the condition required by the present invention can be satisfied easily and reliably.

In mounting the ceramics spike pin of the present invention to a sole, not only resin but also a metal fitting of aluminum, magnesium alloy or stainless steel which applies a large stress concentration upon mounting may be used for the sole.

Other objects and features of the invention will be more fully understood from the following detailed description and appended claims when taken with the accompanying drawings.

DETAILED DESCRIPTION OF THE PREFERRED EMBODIMENTS

There will now be described a preferred embodiment of the present invention with reference to the drawings.

Figure 1:
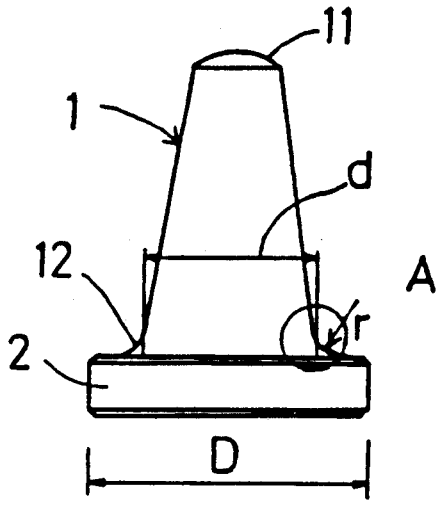
FIG. 1 is an elevational view of the spike pin according to a preferred embodiment of the present invention.

As shown in FIG. 1, the spike pin of the preferred embodiment is comprised of a pin body 1 having a free end portion 11 and a connecting base portion 12, and of a horizontally expanded base 2. The pin body 1 has a substantially circular conical shape with the end portion 11 truncated and rounded. A horizontal cross section of the pin body 1 is really circular, and an outer circumference thereof is rounded. The horizontally expanded base 2 has a circular disk-shaped configuration, and outer circumferences of the end portion 11 and the expanded base 2 are rounded.

Figure 2:
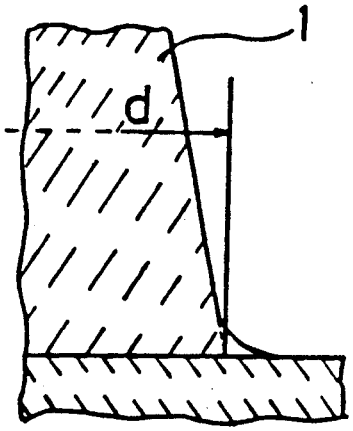
FIG. 2 is as enlarged sectional view of an encircled portion A shown in FIG. 1, showing the diameter(d) of the connecting base portion of the pin body.

This spike pin is formed of zirconium oxide ceramics containing 4 mol% of yttrium oxide. The connecting base portion 12 has a radius of curvature(r) set to 0.5 mm$\leqq$r$\leqq$3 mm and a diameter(d) set to d=6 mm, and the horizontally expanded base 2 has a diameter(D) set to 7 mm$\leqq$D$\leqq$12 mm. As shown in FIG. 2, the diameter(d) of the connecting base portion 12 is defined as a distance between intersection points to be obtained by intersecting extentions of tapering lines of the pin body 1 and an upper surface of the horizontally expanded base 2.

This ceramics spike pin has a bending strength of 90 kg/mm$^2$ or more according to JIS R-1601. Further, as shown in Fig. 4, an impact strength (kg·m) was measured by conducting a drop impact test such that the spike pin was fixed through a washer 3 to a fixing jig 4, and a given dropping body 5 is let fall onto the free end portion 11 of the spike pin. Then, the relationship between a value of $r^2 \times d/D$ and the impact strength was investigated to obtain the result shown in FIG. 3.

Figure 3:
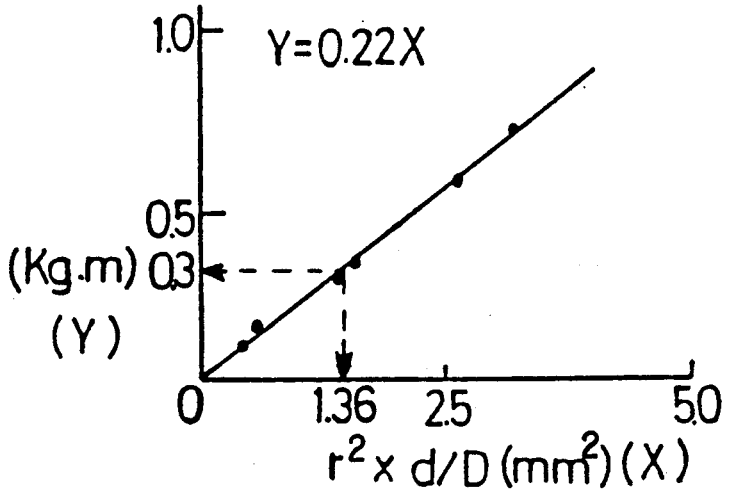
FIG. 3 is a graph illustrating the relationship between $r^2 \times d/D$ and an impact strength in the preferred embodiment.
Figure 4:
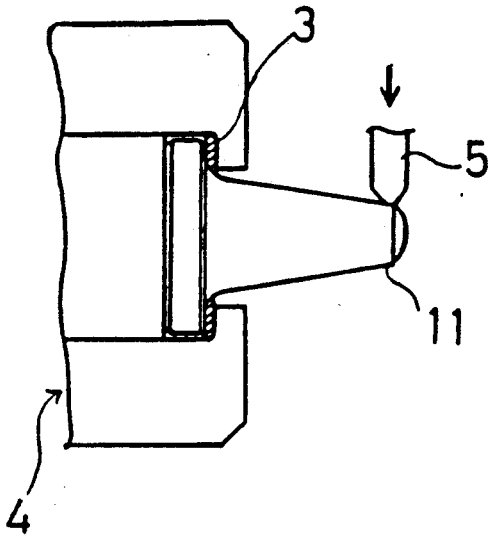
FIG. 4 is a side view illustrating the measurement of an impact strength in the preferred embodiment.
Figure 5:
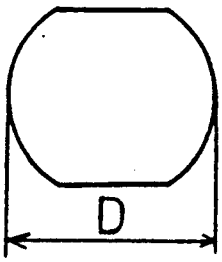
FIG. 5 is a plan view showing a track-shape of the horizontal cross section of the horizontally expanded base.
Figure 6:
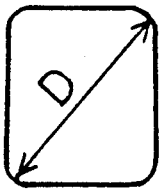
FIG. 6 is a plan view showing a tetragonal shape of the horizontal cross section of the horizontally expanded base.
Figure 7:
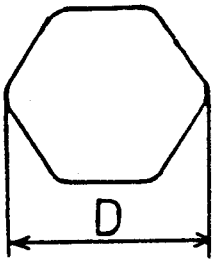
FIG. 7 is a plan view showing a hexagonal shape of the horizontal cross section of the horizontally expanded base.

As apparent from FIG. 3, when the value of $r^2 \times d/D$ is 1.36 or more, the impact strength of 0.3 kg·m or mor is obtained, which satisfies a characteristic to be required in practiacl use. On the other hand, when the value of $r^2 \times d/D$ is less than 1.36, the impact strength of 0.3 kg·m is not satisfied in some cases, which dose not fit for practical use.

According to the construction of the spike pin in the above-mentioned preferred embodiment, a force to be applied to the pin body 1 can be uniformly dispersed by the horizontally expanded base 2, thereby greatly relieving the stress concentration and obtaining a sufficient impact resistance fittable for practical use. Thus, the durability of the spike pin was improved. Furthermore, as the horizontal cross section of the pin body 1 is really circular with the outer circumference thereof rounded, and the free end portion 11 is also rounded, chipping of the pin body 1 is hard to occur, Moreover, as a dimensional difference of 1–6 mm is provided between the connecting base portion 12 and the horizontally expanded base 2, the spike pin can be firmly united with a shoe by using a flange.

Additionally, as the spike pin is formed of partially stabilized zirconia, the impact resistance was improved, and the practiacl use characteristic was easily satisfed. Further, in the formation of the spike pin, a high quality without cracks and ununiformity of density was obtained.

The present invention is not limited to the above-mentioned preferred emboidment, but various modifications can be made within the scope of the present invention. That is. the general shape and size of the spike pin, and the shape and sizes of the pin body and the horizontally expanded base may be suitably selected. For example, the shape of the pin body may be modified in such a manner that the tapering line is changed at its middle position. Further, the radius of curvature of the free end portion 11 and the diameter of a truncated free end portion, or the like may be suitably selected.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A ceramics spike pin comprising a pin body having a horizontal cross section of a substantially circular shape, said pin body being provided with a rounded free end portion having a predetermined radius of curvature and a connecting base portion having a predetermined radius of curvature, and a horizontally expanded base connected to said connecting base portion, wherein a diameter (d) of said connecting base portion in horizontal cross section, the radius of curvature (r) of said connecting base portion, and a maxiumum diagonal length (D) of said horizontally expanded base satisfy the relationship of $0<r<d<D$ and $r^2 \times d/D \geqq 1.36$.

2. The ceramics spike pin as defined in claim 1, wherein said ceramics are selected from the group consisting of a partially stabilized zirconia sintered material and a cermet having a bending strength of 90 $kg/mm^2$ or more and a fracture toughness of 5 $MN/m^{\frac{1}{2}}$ or more.

3. The ceramics spike pin as defined in claim 1, wherein a difference between said maximum diagonal length (D) and said diameter (d) is set to 1 –6 mm.

4. The ceramics spike pin as difined in claim 1, wherein said maximum diagonal length (D) is set to 15 mm or less.

5. The ceramics spike pin as defined in claim 1, wherein said pin body has substantially circular conical shape with said free end portion truncated, and the horizontal cross section of said pin body is really circular with a rounded outer circumference.

6. The ceramics spike pin as defined in claim 1, wherein said horizontally expanded base has a circular disk-shaped configuration, and an outer circumference thereof is rounded.

7. The ceramics spike pin as defined in claim 1, wherein said horizontally expanded base has a track-shaped configuration with rounded corners.

8. The ceramics spike pin as defined in claim 1, wherein said horizontally expanded base has a polygonal shape with rounded corners.

9. The ceramics spike pin as defined in claim 8, wherein said horizontally expanded base has a tetragonal shape.

10. The ceramics spike pin as defined in claim 8, wherein said horizontally expanded base has a hexagonal shape.

* * * * *